US006102303A

United States Patent [19]

Bright et al.

[11] Patent Number: 6,102,303

[45] **Date of Patent: *Aug. 15, 2000**

[54] FUEL INJECTOR WITH INTERNAL HEATER

[75] Inventors: John S. Bright; Jerry E. Nines, both of Newport News; Michael J. Frick, Yorktown; Frank Zimmermann, Newport News, all of Va.; Christoph Kendlbacher, Vienna, Austria; John F. Nally, Jr., Williamsburg; Wei-Min Ren, Yorktown, both of Va.

[73] Assignee: Siemens Automotive Corporation, Auburn Hills, Mich.

[ * ] Notice: This patent is subject to a terminal disclaimer.

[21] Appl. No.: 09/088,127

[22] Filed: Jun. 1, 1998

Related U.S. Application Data

[63] Continuation-in-part of application No. 08/627,707, Mar. 29, 1996, Pat. No. 5,758,826.

[60] Provisional application No. 60/053,530, Jul. 23, 1997.

[51] Int. Cl.[7] ..... B05B 1/24

[52] U.S. Cl. ..... 239/135; 239/585.1; 239/585.4; 239/585.5; 251/129.21; 137/341

[58] Field of Search ..... 239/1, 5, 13, 128, 239/135, 136, 139, 461, 463, 533.1, 533.2, 533.9, 533.12, 533.15, 569, 583, 584, 585.1, 585.4, 585.5; 251/129.21; 137/341; 123/549, 557, 558; 219/541, 205, 270; 277/943, 919; 174/65 G, 151, 152 G, 153 G, 135

[56] References Cited

U.S. PATENT DOCUMENTS

| | | | |
|---|---|---|---|
| 3,868,939 | 3/1975 | Friese et al. | 123/179 L |
| 3,876,861 | 4/1975 | Wightman et al. | 219/463 |
| 3,927,300 | 12/1975 | Wada et al. | 219/381 |
| 4,032,752 | 6/1977 | Ohmura et al. | 219/541 |
| 4,279,234 | 7/1981 | Marcoux et al. | 123/549 |
| 4,447,706 | 5/1984 | Eder et al. | 219/299 |
| 4,458,655 | 7/1984 | Oza | 123/558 |
| 4,572,146 | 2/1986 | Grunwald et al. | 123/549 |
| 4,622,069 | 11/1986 | Berg et al. | 219/553 |
| 4,627,405 | 12/1986 | Imhof et al. | 123/549 |
| 4,713,524 | 12/1987 | Leo et al. | 219/307 |
| 4,760,818 | 8/1988 | Brooks et al. | 123/298 |
| 4,826,082 | 5/1989 | Greiner et al. | 239/585.4 |
| 4,834,043 | 5/1989 | Kaczynski et al. | 123/549 |
| 4,870,249 | 9/1989 | Kayanuma et al. | 219/206 |
| 4,898,142 | 2/1990 | Van Wechem et al. | 123/557 |
| 5,056,495 | 10/1991 | Yamashita | 123/549 |
| 5,114,077 | 5/1992 | Cerny | 239/483 |
| 5,207,384 | 5/1993 | Horsting | 239/463 |
| 5,218,943 | 6/1993 | Takeda et al. | 123/531 |
| 5,361,990 | 11/1994 | Pimentel | 239/133 |
| 5,389,195 | 2/1995 | Ouderkirk et al. | 156/643 |

(List continued on next page.)

FOREIGN PATENT DOCUMENTS

| | | |
|---|---|---|
| 4-350360 | 4/1992 | Japan . |
| WO 92/10011 | 6/1992 | WIPO . |

*Primary Examiner*—Andres Kashnikow
*Assistant Examiner*—Lisa Ann Douglas

[57] ABSTRACT

A fuel injector has an internal heater energized during cold starting to reduce emissions, the heater being a ceramic hollow cylinder disposed within a valve body just upstream of a valve seat where fuel is injected through an orifice into the engine. Conductors for energizing the heater extend into the valve body and are sealed against the escape of pressurized fuel. In one version, the conductors extend through an O-ring to be sealed. In another version the conductors include pins extending through the valve body sidewall with glass seals fused to the valve body and the pins. The conductors may comprise flat foil strips clamped between the O-ring and an elastomeric washer. The conductors also may be molded into the magnetic coil bobbin and sealed where the conductors emerge into the fuel cavity. The heater has metallized surfaces to create current flow through its wall thickness, and the conductors are electrically connected respectively to the inner end and outer surfaces of the hollow cylinder by metallization patterns enabling both mechanical contacts on the outside of the heater.

37 Claims, 9 Drawing Sheets

U.S. PATENT DOCUMENTS

| | | | |
|---|---|---|---|
| 5,400,969 | 3/1995 | Keene | 219/205 |
| 5,401,935 | 3/1995 | Smith et al. | 219/206 |
| 5,609,297 | 3/1997 | Gladigow et al. | 239/135 |
| 5,634,597 | 6/1997 | Krohn et al. | 239/585.1 |
| 5,758,826 | 6/1998 | Nines | 239/136 |
| 5,765,750 | 6/1998 | Pace et al. | 239/5 |
| 5,836,289 | 11/1998 | Thring | 123/549 |
| 5,915,626 | 6/1999 | Awarzamani et al. | 239/135 |

FUEL INJECTOR WITH INTERNAL HEATER

CROSS-REFERENCE TO RELATED APPLICATION

This application expressly claims the benefit of earlier filing date and right of priority from the following co-pending patent applications: Provisional Application U.S. Ser. No. 60/053,530, (Attorney Docket 97 P 7677 US), entitled "Heated Fluid Valve," filed on Jul. 23, 1997. This application is also a continuation-in-part of U.S. Application Ser. No. 08/627,707, (Attorney Docket 96 P 7660 US), entitled "Fuel Injector With Internal Heater," filed on Mar. 29, 1996 now U.S. Pat. No. 5,758,826. Both cited patent applications are expressly incorporated in its entirety by reference.

BACKGROUND OF THE INVENTION

This invention concerns fuel injectors for controllably injecting fuel into the intake manifold or cylinders of automotive engines. Fuel injection occurs when a small diameter needle valve is lifted from a valve seat to allow pressurized fuel to spray out through a valve seat orifice and into the engine where it vaporizes.

It has heretofore been recognized that preheating of the fuel during cold starting will greatly reduce emissions caused by incomplete fuel vaporization during cold starts.

Various heater arrangements have been proposed, including an external heater jacket on the injector body, a heater internally of the injector, such as described in copending U.S. Ser. No. 08/627,707, now U.S. Pat. No. 5,758,826, as well as U.S. Pat. Nos. 4,458,655; 3,868,939 and 4,898,142. Another approach is a heater element downstream of the valve seat, on which fuel is sprayed when the valve injector opens, such as described in U.S. Pat. Nos. 4,627,405 and 4,572,146.

An advantageous arrangement is an internal heater just upstream of the valve seat as described in copending U.S. Ser. No. 08/627,707, filed on Mar. 29, 1996now U.S. Pat. No. 5,758,826, which maximizes the heating of the fuel that occurs just prior to injection. In this arrangement, the presence of the heater does not affect the spray pattern, as may occur with the downstream heaters referenced above. Coking problems also arise where heated surfaces are not continuously wet with fuel, as in these downstream heaters.

Complications are encountered in providing electrical connections to a heater located in an internal location where the fuel is present, as electrical conductors must extend from the electrical plug connection where no fuel is present into the space above the valve seat where pressurized fuel from the rail is present. This necessitates a sealing arrangement to prevent the escape of fuel past the conductor.

An object of the present invention is to provide an improved internal fuel injection heater and also arrangements for establishing reliable electrical connections to such internal heater, as well as mountings for the heater structure within the fuel injector.

SUMMARY OF THE INVENTION

The above recited object as well as other objects which will become apparent upon a reading of the following specification and claims are achieved by several arrangements. In a first embodiment, conductive foil strips are molded into an O-ring seal, extending through the O-ring sealing the joint between upper and lower injector housing parts, the strips connected at one end to a hollow cylindrical heater surrounding the needle valve, and at the other to a connector which also supplies power for the injector operating magnetic coil.

In a variation of the molded-in construction, wires from the heater extend through the O-ring and are received in a contact clip connecting the wires to a second set of wires extending to the connector plug contact pins.

In another version, the strips are compressed between the O-ring and an elastomeric disc to be sealed therebetween.

In yet another version, the prong conductors are molded to extend through the bobbin and are sealed thereto, and further extend to engage the heater sleeve to provide an electrical connection thereto.

In another version, used with a fuel injector of a welded construction, external conductors extend outside the valve body from the plug connector, and conductor pins extend into the valve body through fused glass seals. The pins are received in a respective one of slotted terminals integral with each of a pair of heater encircling clips fit over each end of the heater.

The heater sleeve has a metallized coating on the inside and outside, patterns formed therein to allow electrical connections to the inside and outside surfaces of the heater respectively to establish an electrical current flow through the wall thickness of the heater.

The heater is positioned within a heat insulating sleeve, with axial and radial positioning maintained with ribs thereon, and/or with various separate spacer members or spring washers.

The heating capabilities of the heater sleeve can be enhanced with convection improving elements which impart tumble, turbulence, swirl or other flow motion of the fuel over the heater surfaces, by surface configurations increasing the surface area exposed to fuel flow or by throttling devices arranged to optimize the relative flow rates inside and outside the heater.

DESCRIPTION OF THE DRAWING FIGURES

The accompanying drawings, which are incorporated herein and constitute part of this specification, illustrate presently preferred embodiments of the invention, and, together with a general description given above and the detailed description of the preferred embodiments given below, serve to explain the principles of the invention.

Figure 3A:
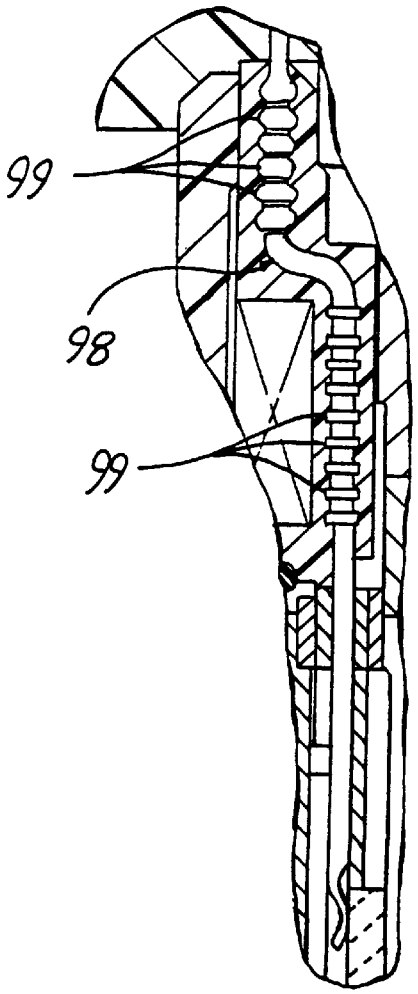
FIG. 3 is a partially longitudinal sectional view of a fuel injector having an internal heater according to the present invention equipped with a through-the-bobbin power conductor arrangement.

FIG. 3*a* is a fragmentary sectional view of an injector showing an alternate terminal sealing arrangement.

Figure 4:
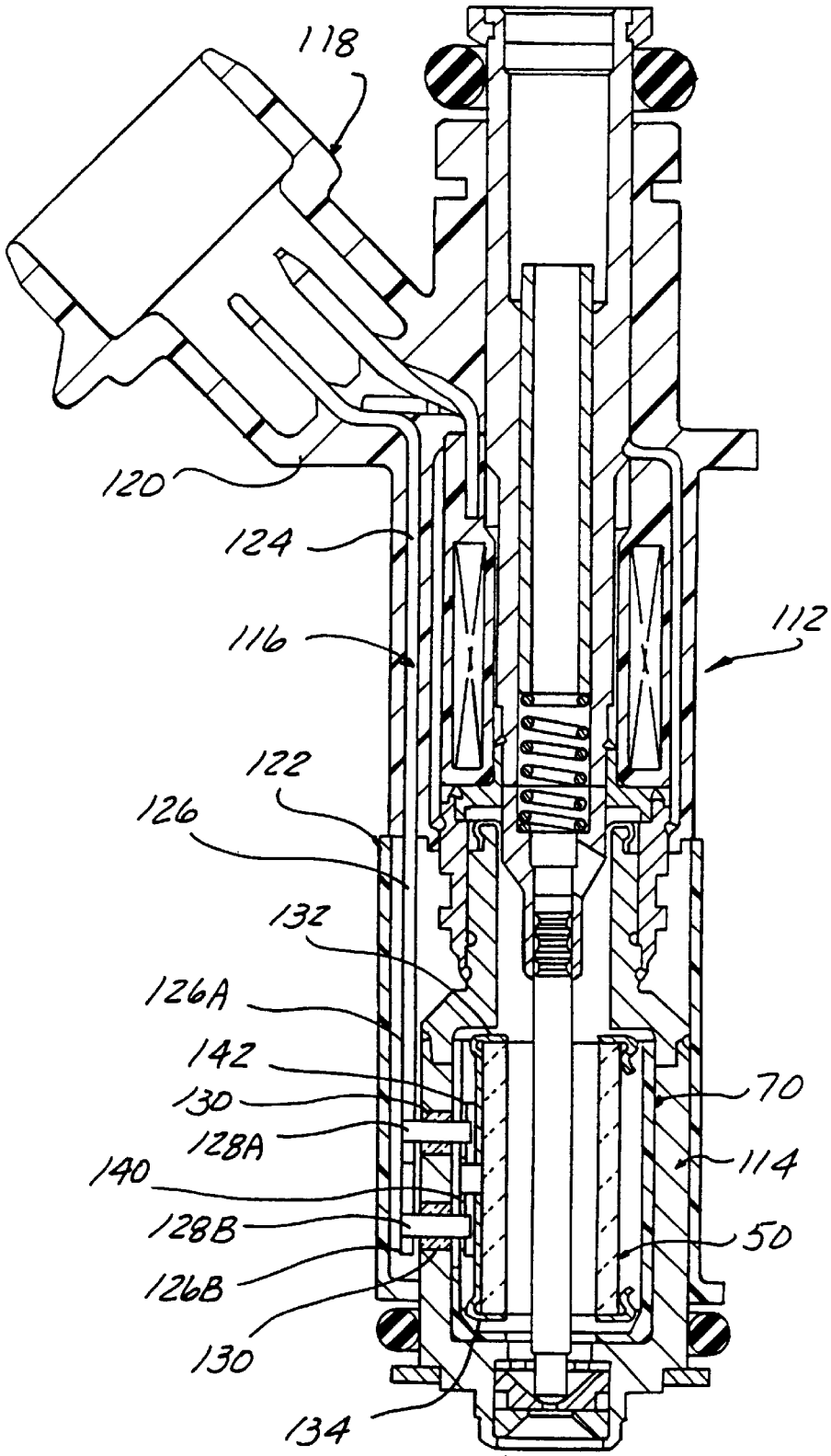

FIG. 4 is a longitudinal sectional view of a fuel injector having an internal heater with an arrangement of external conductors passing through glass seals fused in bores extending into the valve body of the injector and received in respective heater clips fit to the heater sleeve.

Figure 5:
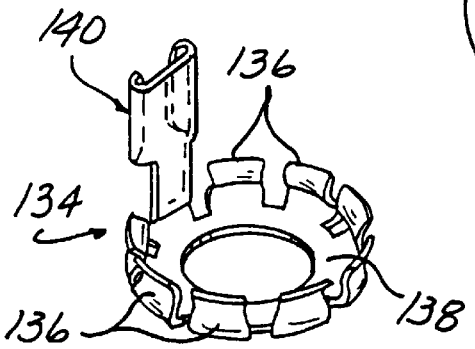

FIG. 5 is a perspective view of one of the heater clips shown in FIG. 4.

Figure 5A:
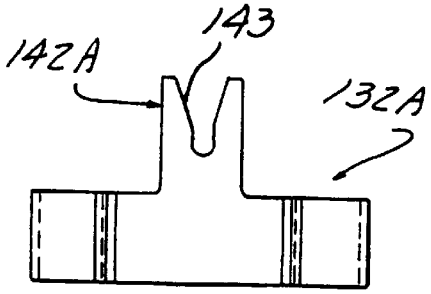

FIG. 5A is a side elevational view of an alternate form of a heater clip.

Figure 5B:
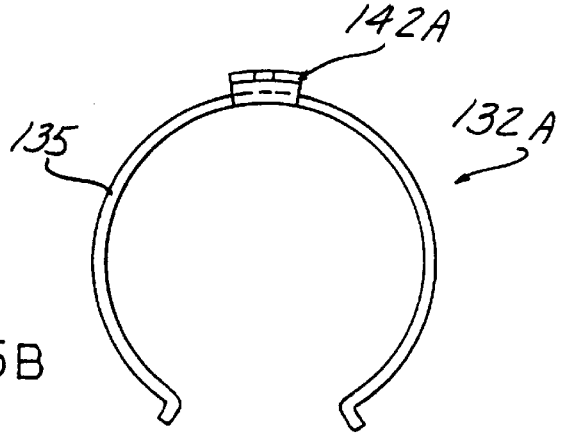

FIG. 5B is a plan view of the clip shown in FIG. 5A.

Figure 6:
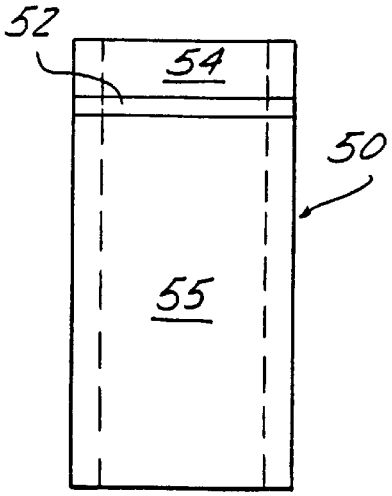

FIG. 6 is an enlarged side view of the hollow cylinder heater showing a first metallization pattern.

Figure 7:
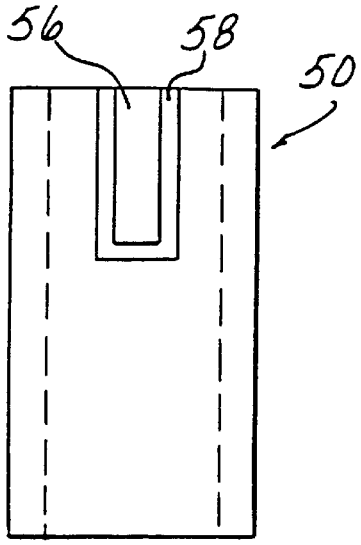

FIG. 7 is an enlarged side view of the heater showing an alternate metallization pattern.

Figure 8:
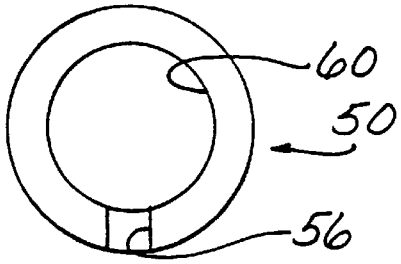

FIG. 8 is an end view of the heater showing another part of the pattern shown in FIG. 7.

Figure 9B:
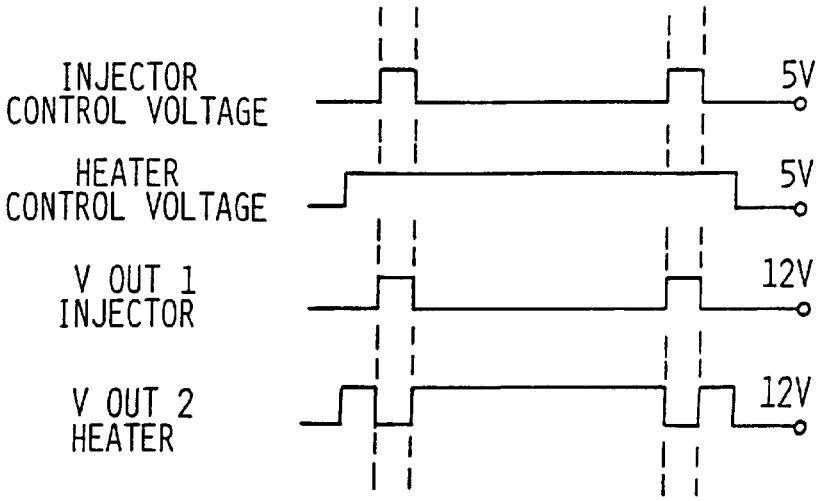
Figure 9A:
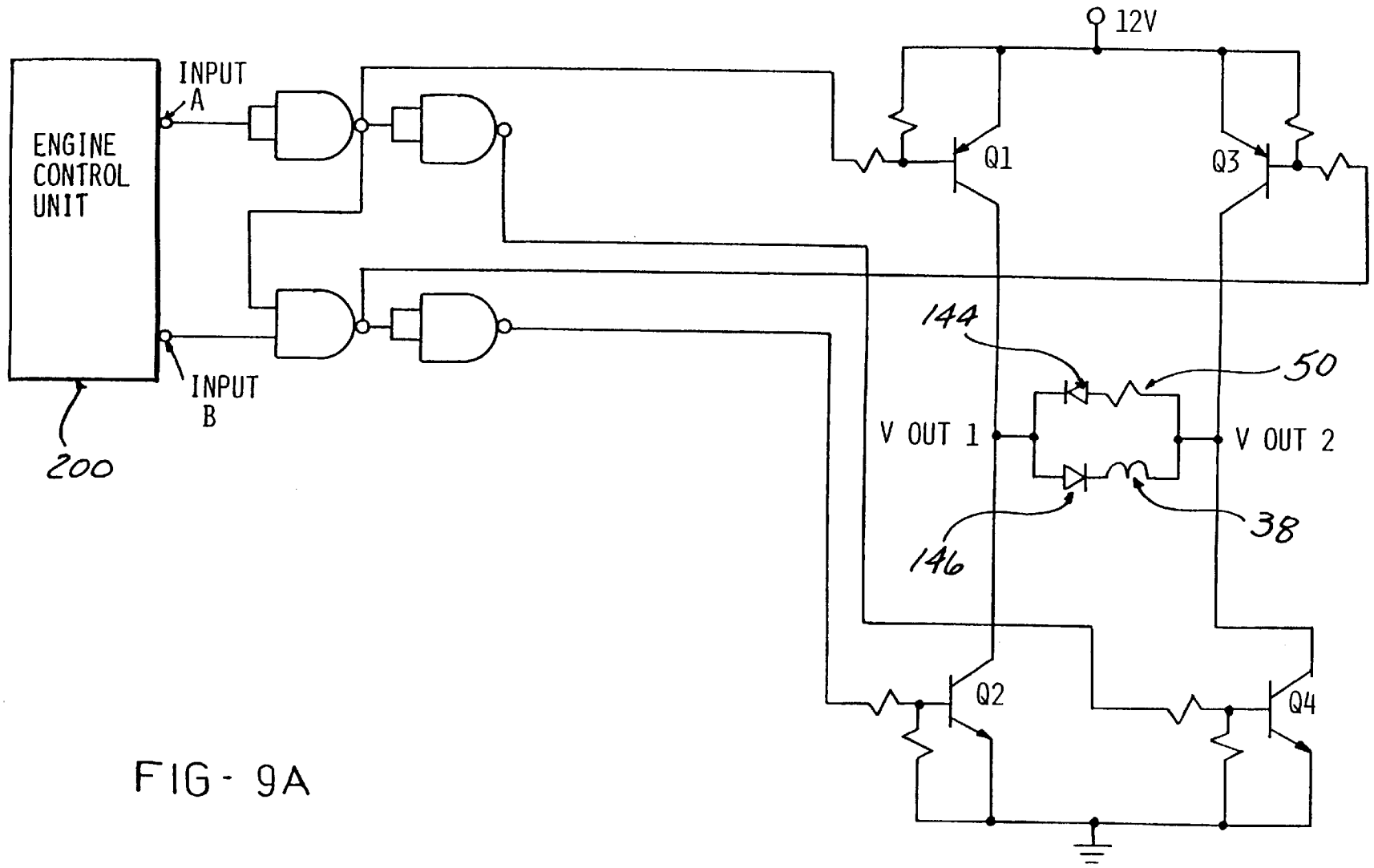

FIG. 9A is a schematic diagram of an electrical isolator used to reduce the number of conductors required to the injector.

FIG. 9B is a timing diagram representing the input logic and output voltage of the circuit of FIG. 9A.

Figure 10:
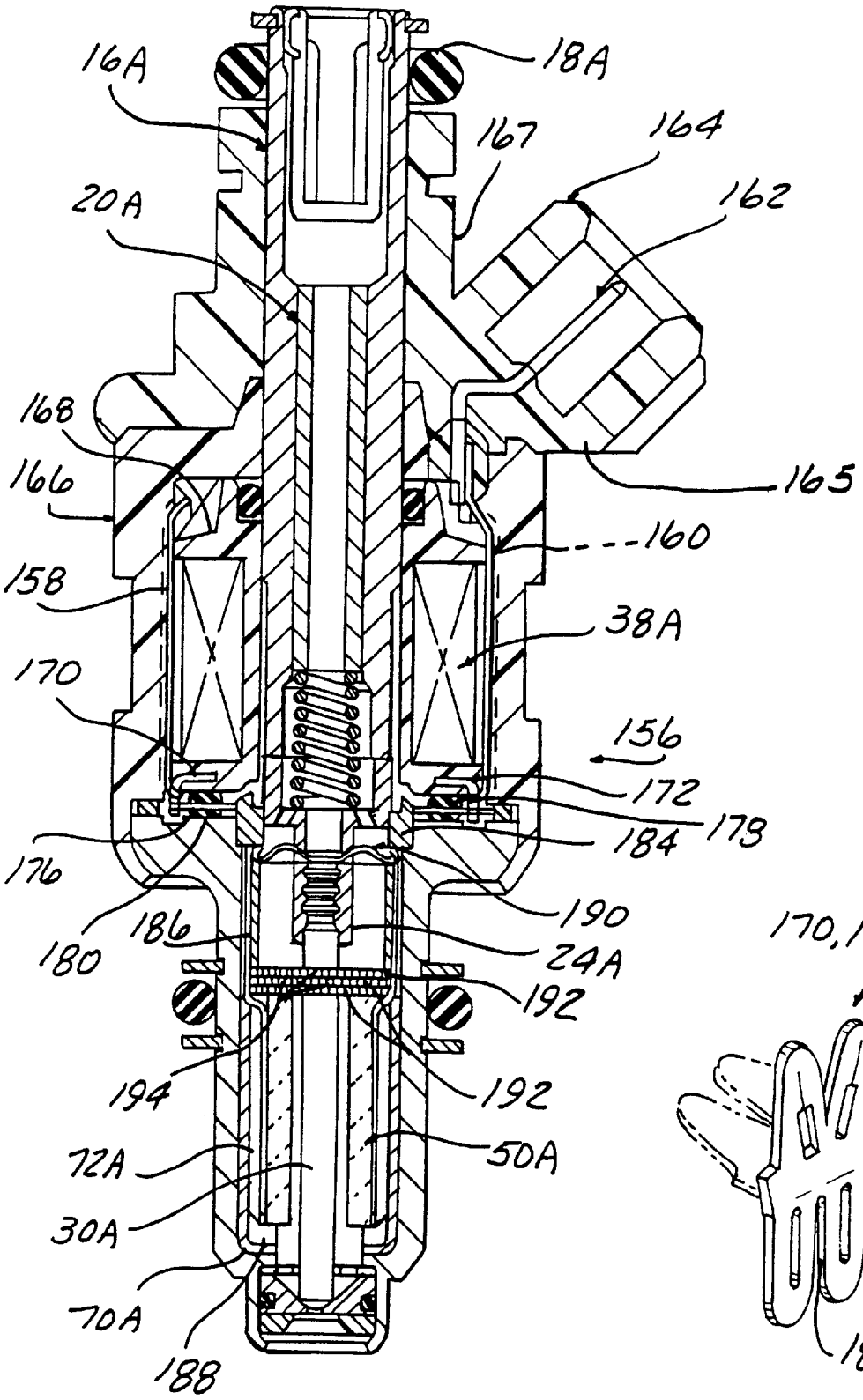

FIG. 10 is a longitudinal sectional view of a fuel injector showing an alternate form of an O-ring penetrating conductor arrangement.

Figure 11:
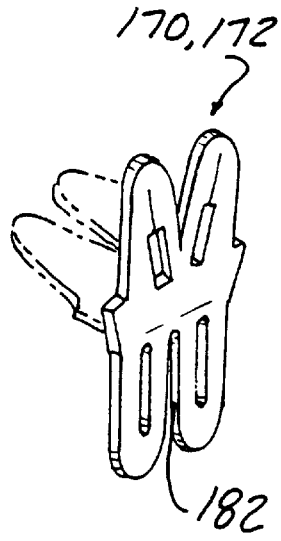

FIG. 11 is a perspective view of an insulation displacement connector used in the fuel injector shown in FIG. 10.

Figure 12:
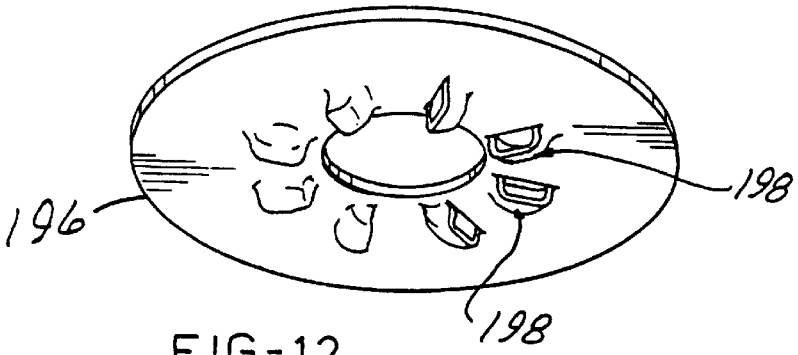

FIG. 12 is a perspective view of a louvered disc optionally useable to opposition flow to the inside and outside surfaces of the heater.

Figure 13:
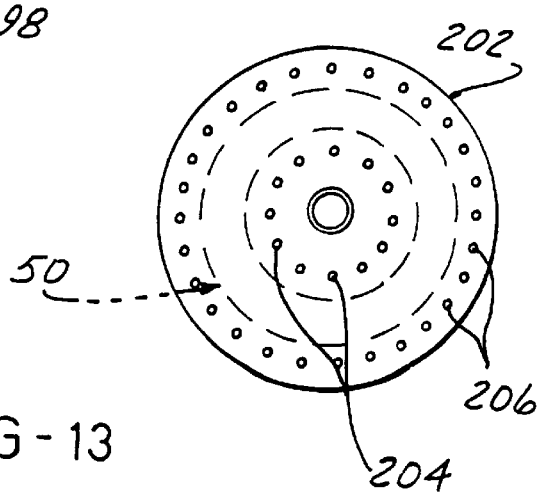

FIG. 13 is a plan view of a flow restrictor disc capable of being placed over the upstream end of the heater.

DETAILED DESCRIPTION

In the following detailed description, certain specific terminology will be employed for the sake of clarity and a particular exemplary embodiment described, but it is to be understood that the same is not intended to be limiting and should not be so construed inasmuch as the invention is capable of taking many forms within the scope of the appended claims.

Figure 1:
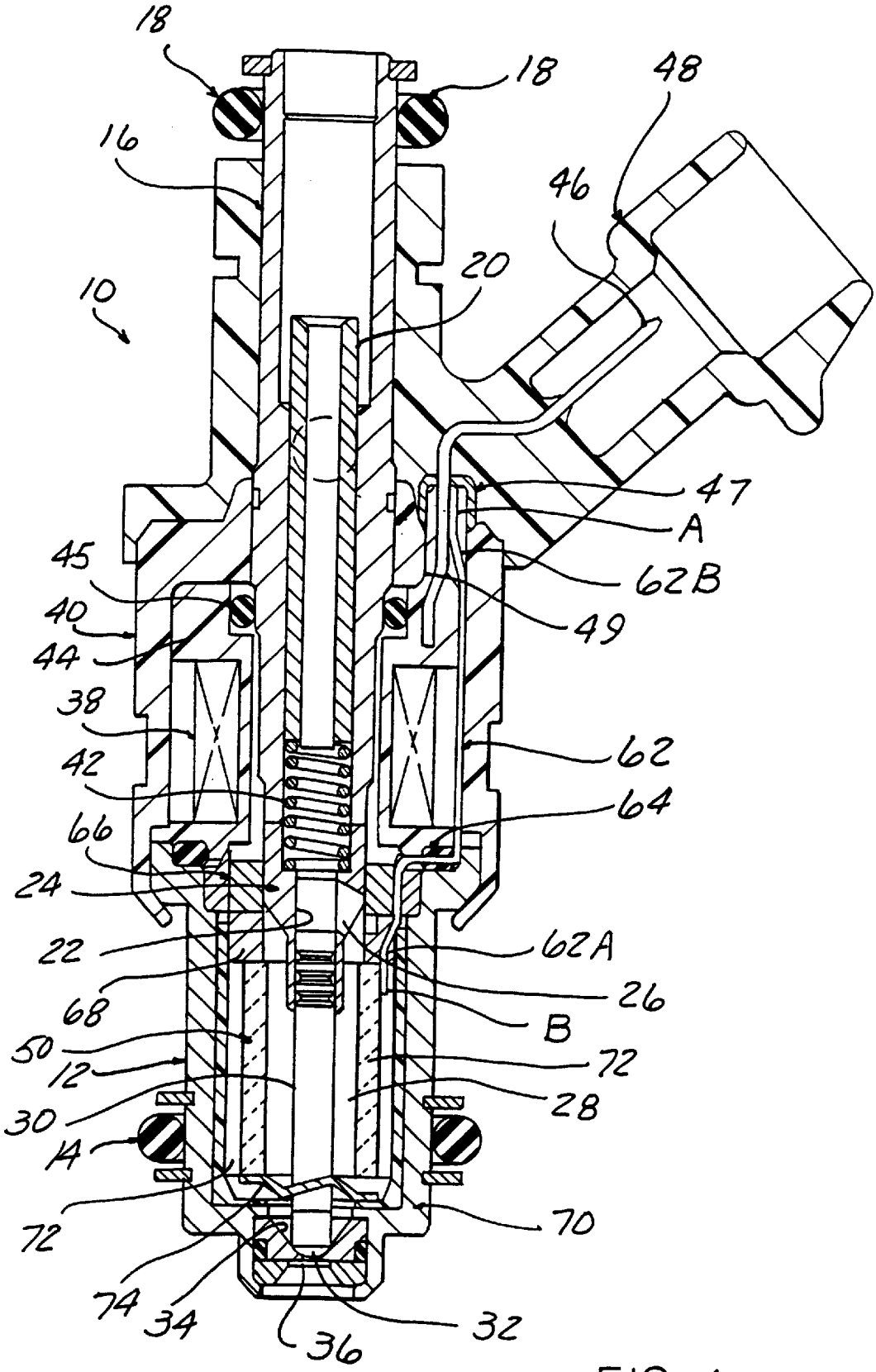
FIG. 1 is a fragmentary sectional view of a fuel injector having an internal heater with an arrangement of flex foil conductors molded into an O-ring seal and disc.

Referring to FIG. 1, a fuel injector 10 includes a valve body 12, adapted to be inserted into an injector seat of an intake manifold or cylinder head of an engine (not shown), with an O-ring 14 at the bottom end sealing the valve body therein.

An inlet tube 16 at the upper end is adapted to be seated in a fuel rail seat (not shown), with an O-ring 18 inlet the upper end of the inlet tube 16 in the fuel rail seat. Fuel under pressure is communicated into the inlet tube 16 through a spring force adjusting tube 20, a bore 22 in a armature 24, and side opening 26, and into a space 28 surrounding a valve needle 30 that is attached to the armature 24. The lower tip end 32 is moved on and off a conical valve seat 34 to control outflow of fuel through an orifice 36 in the seat 34.

An electromagnetic coil 38 in an upper housing 40 when energized lifts the armature 24 off the valve seat 34 against the force of spring 42.

The coil 38 is wound on a molded plastic bobbin 44. A seal 45 prevents the escape of fuel past the upper end of the bobbin 44. A terminal cover 47 seals an opening 49 in the housing 40 preventing the entrance of plastic when the overmold 48 is molded. Three pin or blade contacts 46 are provided passing through the cover (FIG. 1B) in an overmold 48 for mating with a harness connector to provide power to the coil 38 as well as to a hollow cylindrical ceramic fuel heater 50 disposed in the space 28 surrounding the valve needle 30.

The heater 50 is preferably constructed of a positive temperature coefficient material as described in copending allowed patent application U.S. Ser. No. 08/627,707 filed on Mar. 29, 1996, now U.S. Pat. No. 5,758,826. However, the heater 50 is here preferably uncoated with any fuel isolating material. The surfaces of the heater 50 are metallized to be electrically conductive in a pattern such that the electrical current caused to flow through the wall thickness of the hollow cylinder, by making electrical connections to the inside and outside surfaces respectively.

The metallizing which is itself well-known in the art, may be applied in patterns so as to allow both contacts to be made with the O.D. of the heater 50 while establishing electrical contacts to the inside and outside surfaces.

FIG. 6 shows the heater 50 with a first pattern in which an isolating gap 52 in the metallization is formed at one end. The opposite end face is unmetallized. Thus, the metallization in the region 54 provides a connection to the inner surface, and region 55 to the outside allowing both connectors to be disposed on the outside of the heater 50, although axially offset.

FIGS. 7 and 8 show a variation in which an isolated region 56 in the metallization of the O.D. is formed by a gap 58. The region 56 is continued across the end face as seen in FIG. 8, providing an electrical connection to the inside metallized surface 60. In this case, the connections can be made at the same axial level, but will be radially offset.

The metallization should be of sufficient thickness to allow electrical connections thereto by suitable means such as by soldering, or welding, or by mechanical pressure, etc.

In the embodiment shown in FIG. 1, the connection is comprised of two foil conductors 62 (aligned in FIG. 1 so that only one can be seen), each connected by a suitable method such as welding or soldering a respective blade contact. Each conductor 62 extends past the outside of bobbin 44 downwardly to a compressed O-ring 64, and passing through the O-ring 64 molded thereto to enter into the sealed internal spaces containing pressurized fuel.

The conductors 62 are bent downwardly to extend through a slot in ferromagnetic armature guide 66 and through a slot in a heater spacer 68 to the upper end of the heater 50 to which they are soldered at B.

An insulating plastic sleeve 70 encloses the heater 50 with three spaced ribs 72 allowing fuel to be in contact with both the inside and outside surfaces for maximum rate of heat transfer while retaining the heater radially. A spring washer 74 is interposed between the endwall of the sleeve 70 and the lower end face of the heater 50 to hold the same axially.

The surfaces of the heater 50 (or of a conductive element into contact therewith) may be roughened, slotted, corrugated, etc. to further enhance the rate of heat transfer into the fuel in contact with the surfaces thereof.

Figure 1A:
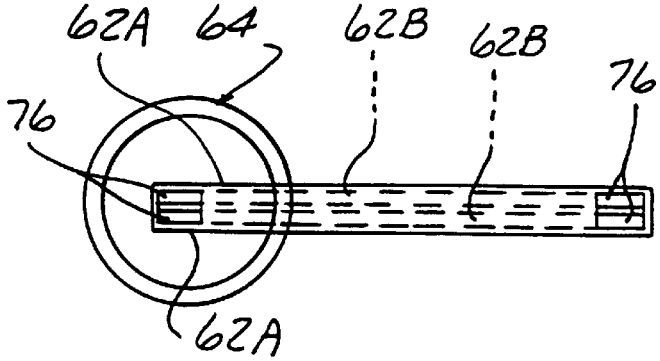
FIG. 1A is a plan view of the molded O-ring with flex foil conductors molded thereinto.
Figure 1B:
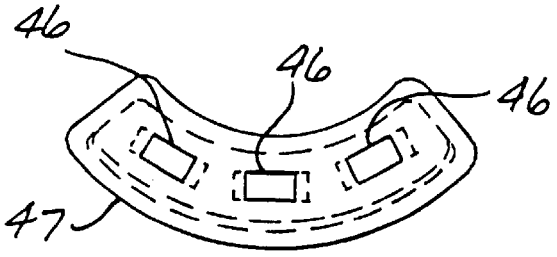
FIG. 1B is a plan view of the terminal cover included in the injector of FIG. 1.

Figure 1A shows further details of the flex foil conductors 62, which have inside ends 62A within the O-ring 64 adapted to be bent down and extended to the heater 50 and outside ends 62B bent up to extend to the contacts 46.

The conductors must be encased in an electrically insulating cover or coating of a plastic, such as Kapton™polyimid. This coating will also provide protection from the fuel if needed.

Soldering or welding openings 76 are provided in the encasing plastic.

The transfer of heat from the heater into the fuel may advantageously be increased by providing heat conducting elements as mentioned above.

Figure 1C:
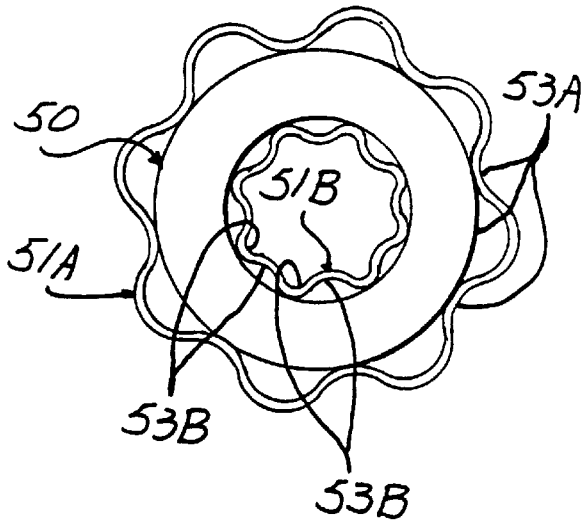
FIG. 1C is an end view of the heater shown in FIG. 1 equipped with optional heat conducting elements.

FIG. 1C shows a pair of tubular heat conducting elements 51A, 51B, which can be constructed of a metal such as beryllium copper. Corrugations for lengthwise inner and outer flutes allow fuel flow over the surfaces of the elements. The elements 51A, 51B are press fit to the outside and inside diameter of the heater 50 respectively to establish a good heat transfer path into the elements 51A, 51B, to heat the same, with the larger area of the flutes 53A, 53B increasing the rate of heat transfer into the fuel.

Figure 2:
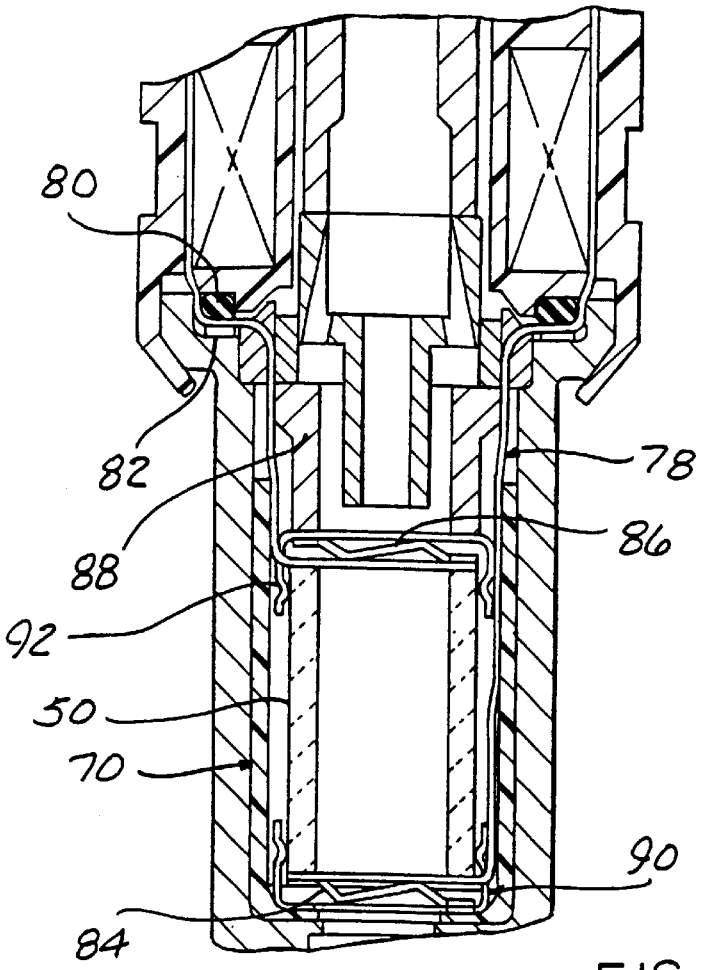
FIG. 2 is a fragmentary sectional view of a fuel injector having an internal heater with an arrangement of flex foil conductors clamped between an O-ring seal and disc.

FIG. 2 shows an alternate version of a heated fuel injector of the electrical connections in which flex foil conductors 78 are compressed between an O-ring 80 and an underlying elastomeric washer 82. (Certain normally included injector components are not shown in FIG. 2).

The heater 50 is positioned between a pair of spring washers 84, 86, the lower washer 84 against a lower heater clip 90 end wall of the insulating sleeve 70, the upper washer 86 beneath an upper heater clip 92 below a spacer 88.

In this version, a conductor flex foil strip 78 extends to the lower end of the heater 50 and is held against the lower end by the lower heater clip 90 and conductor flex foil strip 78 extends to the upper end of the heater 50 where it is held against the upper end with the upper heater clip 92.

Figure 3:
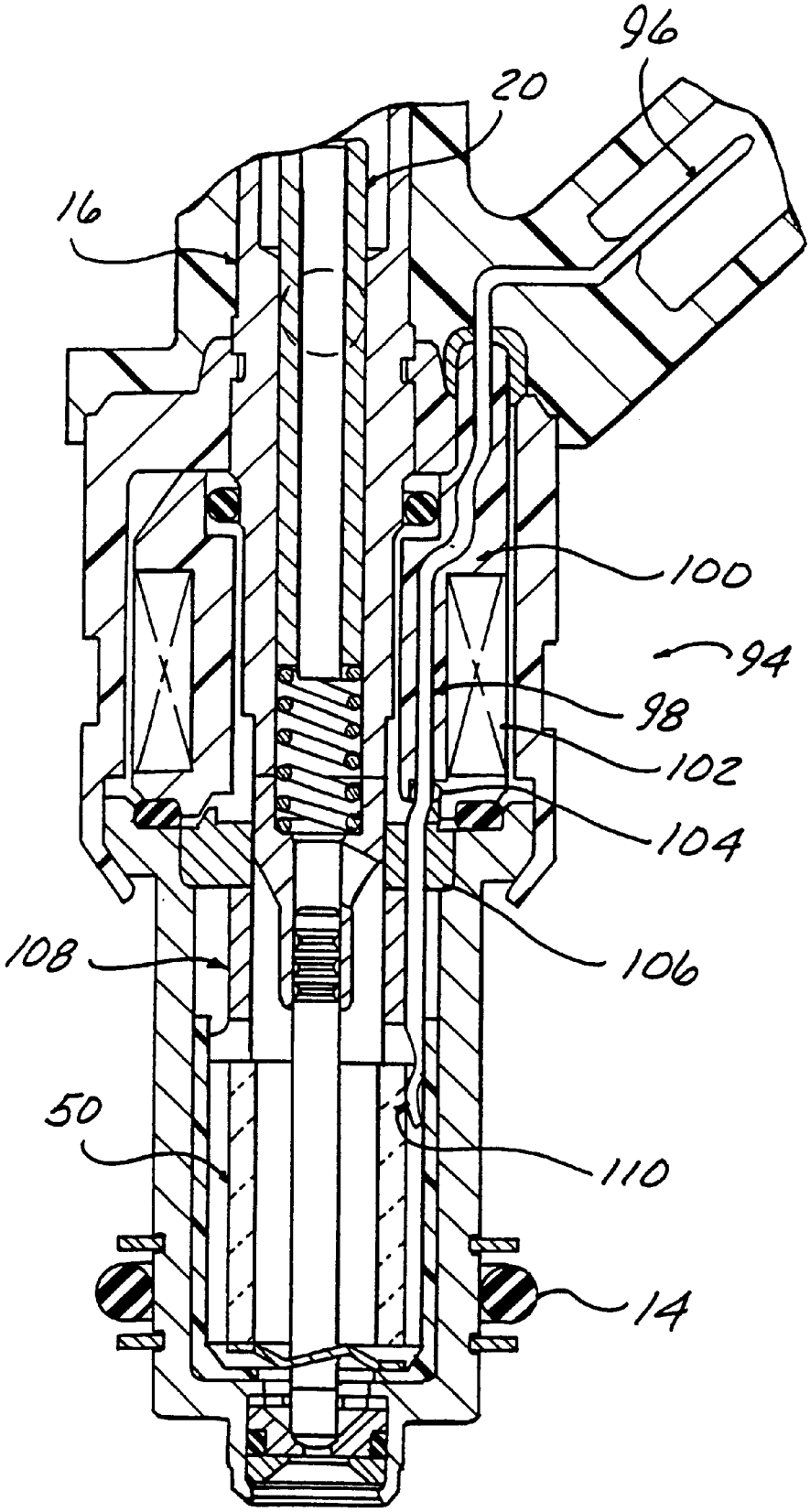

FIG. 3 illustrates an injector 94 utilizing a through-the-bobbin conductor design. The connector pins 96 used to energize the hollow cylindrical heater 50 are integral with conductor terminals 98 which extend through a bobbin 100 on which the injector coil 102 is wound (the terminals 98 are one behind the other so only one is seen in FIG. 3).

Terminals 98 are sealed from fuel leakage by an elastomeric seal 104 surrounding each terminal 98 where it emerges into the internal spaces where the pressurized fuel is present. Sealing of the terminals 98 can also be achieved by a suitable coating applied before molding to create a bonding with the plastic. Also, a knurling or corrugation 99 in the terminal 98 forming a tortuous leak path can also provide sealing (FIG. 3*a*). The terminal 98 continues through a ferromagnetic armature guide bushing 106, past a spacer sleeve 108.

A spring finger terminal portion 110 of each terminal 98 is held against the upper side of the heater 50, establishing an electrical contact with a respective metallized region for each prong 98.

FIG. 4 shows a laser welded fuel injector 112 of the type described in U.S. application Ser. No. 08/688,937, filed on Jul. 31, 1996 now U.S. Pat. No. 5,775,600, in which a welded construction is employed, utilizing hermetic laser welds to eliminate the need for internal O-ring seals, and of a compact configuration not easily accommodating internal conductors for the heater 50 disposed in the valve body 114.

Accordingly, a pair of conductors 116 extend from the connector socket 118 alongside the injector 112, the upper portions 124 contained within the overmolding 120, the lower portions 126A, 126B extending into a plastic, electrically insulating cover 122 enclosing the valve body 114 and connecting housing components. The lower portions 126A, 126B extend opposite the heater 50, and have contact pins 128A, 128B electrically connected thereto as by welding or soldering, and extending through the sidewall of the valve body 114.

A glass seal 130 is fused to each of the pins 128A, 128B as well as the bores in the valve body side wall. The steel of the pins 128A, 128B and valve body 114 is first oxidized to improve bonding of the glass used in the seals 130, which may be leaded or of other types of glass.

The heater 50 has an upper spring clip 132 and lower spring clip 134 secured on opposite ends. FIG. 5 shows the lower spring clip 134 which is similar to the upper spring clip 132.

A series of spaced apart spring fingers 136 are arranged about the circumference of an annular disc fit against the end of the heater 50. A terminal 140 extends axially upwardly in place of one of the spring fingers 136. The terminal 140 defines a channel sized to allow pin 128B to be gripped as it is slid thereinto as the heater 50 is inserted into the insulating sleeve 70.

The upper spring clip 132 may have a terminal 142 sized to allow the lower pin 128B to pass through freely, with pin 128A sized to tightly grip the same as the heater 50 is pushed into its final position.

FIGS. 5A and 5B show an alternative "hose clamp" type of spring clip 132A, which relies on the grip of a split band 135 to establish an electrical connection. An upwardly or downwardly projection terminal 142A has a slot 143 sized to receive the contact pins 128A and 128B.

The connections between the pins 128A and 128B and terminals 140, 142 serve to secure the heater 50 axially in the sleeve 70. The heater 50 is located radially with ribs as in the above embodiments.

In order to receive only two conductors to the injector, electrical isolators may be employed inside the injector. A control circuit will switch the voltage polarity applied to the two conductors of the injector. This will energize the injector solenoid or heater respectively, as shown schematically in FIG. 9A.

In FIG. 9A, the heater 50 is connected in series with diode 144 and the injector solenoid 38 is connected in series with diode 146 and the two series circuits are connected in parallel inside the injector.

FIG. 9A shows the control circuit that controls the polarity of the voltage applied to the injector conductors. With a pulse applied to injector input A, the voltage at Vout1 will be positive with respect to Vout2 and the injector solenoid will be energized. With a pulse applied to heater input B, and the injector is turned off (injector input A=0 volts) the voltage at Vout2 will be positive with respect to Vout1 and the heater will be energized.

FIG. 9B is a timing diagram that represents the input logic control and output voltage across the injector solenoid and heater circuits. The input A injector control voltage has precedence over input B heater control voltage. If the heater is turned on (Vout2 positive with respect to Vout1) the output will reverse while input A is high.

A possible control strategy for port injection applications is to energize the heater at or before engine start until the exhaust catalyst lights or the intake valves and air passage walls become hot enough that heater operation is not advantageous. This time can be determined experimentally and stored in the engine control unit 200 based on ambient conditions and engine temperature at start time and driving cycle after start or the heaters can be run for an unvaried pre-determined time.

Injection can be timed to an open intake valve when the heater is operated to reduce wall wetting since atomization will be sufficient to prevent condensation in the cylinder.

Any of various strategies can be employed to reduce heater current during starter engagement such as heater energization before starter engagement, reduced voltage during start, series resistor of zero or negative temperature coefficient, optimized selection of heater size and resistance or others.

FIG. 10 shows another variation in a fuel injector 156. In this version, insulated wires 158,160 extend from pin contacts 162 of a socket 164 adapted to mate with a plug connector (not shown). An overmold 165 can encase the connections to the pin contacts 162 prior to producing the main overmold 167 to simplify manufacturing. Each of the insulated wires 158, 160 extend through a recess in a coil housing 166 behind an operating coil 38A wound on a bobbin 168, the recesses in a bore in the housing 166 which receives the bobbin 168.

A pair of insulation displacement connectors 170, 172 are molded into the bobbin 168 and each have a notch 182 receiving a respective wires 158 and 160 at the top, establishing an electrical connection to the connector contacts (FIG. 11). A second pair of wires 176, 178 extend through the O-ring seal 180 from opposite sides, and are each also received in notch 182 in connectors 170, 172 (FIG. 11) when the injector parts are assembled.

The second pair of insulated wires 176, 178 pass through slots in an armature guide ring 184 receiving the armature piece 24A holding the needle valve 30A.

The wires 176, 178 extend down to the hollow cylindrical heater 50A where a soldered joint to the metallized surface establishes the electrical connection.

An insulated sleeve 70A has lengthwise ribs 72A to center the heater 50A and also end ribs 188 on which the heater 50A rests. A wave spring washer 190 acts on the upper end of the spacer sleeve 186 and a stack of turbulence inducing plates 192 to hold the heater 50A against the ribs 188.

The turbulence inducing plates 192 are each formed with offset slots 194 which cause the fuel to pass through in a tumbling, turbulent flow pattern prior to passing over the inner and outer surfaces of the heater 50A to enhance heat transfer into the fuel. The slot pattern can also be varied to apportion the fuel flow over the inside and outside of the heater to optimize heat transfer for a particular application.

Texturing the surface or shaping of the heater 50A with ribs, corrugations, etc. can also be employed to increase the rate of conductive heat transfer.

FIG. 12 shows the underside of a louvered plate 196 which has a circular array of louvers 198 utilized to create turbulence by causing a redirection of flow into the inside of the heater 50.

FIG. 13 shows a flow restrictor disc 202 placed over the upstream end of the heater 50. A pair of circumferential array of holes 204, 206 is aligned with the inner and outer perimeter of the heater 50. The relative areas of the array allows control over the relative flow rates of fuel passing over the heater's inner and outer surfaces. This may be desirable in a given application to maximize heat transfer, i.e., the greater surface area of the outside would indicate a greater flow rate over the outside. On the other hand, a lower inside heat losses may indicate a greater flow rate to the inside.

Accordingly, each specific design must be analyzed to set the apportionment of fuel flow rates to the inside and outside as indicated by setting the relative restrictive effect of the hole arrays.

What is claimed is:

1. A fuel injector comprising:

a valve body having a bore therein adapted to receive fuel;

a valve seat mounted at one end of the valve body having an orifice;

a needle valve having one end mounted to an armature and another end configured to be seated onto the valve seat to close off fuel outflow from the bore, and unseated from the valve seat to allow fuel to be sprayed from the valve bore;

a magnetic coil operator assembly mounted in a housing attached to another end of the valve body, and including electrical connectors to connect the magnetic coil operator assembly to an electrical control circuit;

a heater surrounding the needle valve in the bore of the valve body upstream of the valve seat and downstream of the magnetic coil operator assembly so that fuel surrounds the heater;

conductors that extend into the bore from the assembly housing, past the magnetic coil operator assembly, and electrically connect to the heater; and sealing means associated with each of the conductors preventing escape of pressurized fuel in the bore past the conductors.

2. The fuel injector according to claim 1, wherein the fuel injector includes an O-ring seal located in a region between the assembly housing and the valve body to provide the sealing means.

3. The fuel injector according to claim 2, wherein the conductors are molded into the O-ring seal.

4. The fuel injector according to claim 2, wherein the conductors extend through the O-ring.

5. The fuel injector according to claim 2, wherein the conductors are at least partially encased in a plastic coating.

6. The fuel injector according to claim 1, wherein the heater is constructed of a positive temperature coefficient ceramic material and has metallized surfaces and the conductors are in contact with the metallized surfaces to establish an electrical contact.

7. The fuel injector according to claim 6, wherein the metallized surfaces are arranged in electrically separated patterns and the conductors are each in contact with a respective one of the patterns.

8. The fuel injector according to claim 7, wherein the heater is a hollow cylinder and the separated patterns are associated with the inside and outside surfaces of the heater respectively.

9. The fuel injector according to claim 7, wherein the separated patterns both include sections on the outer surface of the heater and both of the conductors make contact with the outer surface of the heater.

10. The fuel injector according to claim 1, wherein the sealing means comprises an O-ring seal located in a region between the assembly housing and the valve body, and an elastomeric washer against which the O-ring is compressed, wherein the conductors each include sections clamped between the O-ring and the washer to be sealed thereto.

11. The fuel injector according to claim 10, wherein the conductors comprise foil strips.

12. The fuel injector according to claim 11, wherein the foil strips are at least partially encased in plastic to be protected from contact with fuel and prevent electrical shorting.

13. The fuel injector according to claim 1, wherein the conductors extend along the outside of the valve body, and further including pin contacts extending through bores in a sidewall of the valve body, the sealing means sealing the pin contacts to the bores.

14. The fuel injector according to claim 13, wherein the sealing means comprises fused glass seals in the bores each surrounding the pin contacts.

15. The fuel injector according to claim 14, further including a pair of clips pressed onto the heater, each including a terminal having a channel for receiving a respective one of the pin contacts to establish an electrical contact.

16. The fuel injector according to claim 15, wherein the heater is a hollow cylinder of a ceramic material and the clips are each circular bodies having a series of spring fingers arranged around the perimeter thereof gripping a respective end of the heater.

17. The fuel injector according to claim 15, wherein the clips each have the terminal extending alongside the heater to be received over a respective pin contact protruding through a sidewall of the valve body.

18. The fuel injector according to claim 1, wherein the fuel injector includes a bobbin carrying magnetic coil, and wherein the conductors extend through the bobbin with a seal associated with each one of the conductors at a location where the conductors emerge from the bobbin.

19. The fuel injector according to claim 18, wherein the conductors each include a prong portion urged into contact with the perimeter of the heater to establish electrical contact.

20. The fuel injector according to claim 1, wherein the heater is a hollow cylindrical body of positive temperature coefficient material.

21. The fuel injector according to claim 20, further including an insulating sleeve having axial ribs on the inside thereof locating the heater radially.

22. The fuel injector according to claim 20, further including at least one spring washer axially locating the heater.

23. The fuel injector according to claim 1, further including an electrical isolator circuit means associated with both the magnetic coil operator assembly and the heater enabling each to be energized using a single common conductor.

24. The fuel injector according to claim 1, further including a turbulent flow inducing component located upstream of the heater.

25. The fuel injector according to claim 24, wherein the turbulent flow inducing component comprises a stack of plates each having a series of slots offset from the slots in other plates in the stack.

26. The fuel injector according to claim 1, further including a heat conducting element mounted in contact with both fuel and the heater.

27. The fuel injector according to claim 26, wherein the heater comprises a hollow cylindrical body and the heat conducting element comprises a metal sleeve fit to the heater, the sleeve having lengthwise extending flutes.

28. The fuel injector according to claim 27, further including a second heat conducting element comprising a metal sleeve having lengthwise flutes, one of the elements press fit to an outside diameter of the heater, the other press fit to an inside diameter of the heater.

29. The fuel injector according to claim 18, wherein the bobbin is of molded plastic, and wherein the conductors are formed with a series of ribs molded into the bobbin to present a tortuous sealing against fuel leakage.

30. The fuel injector according to claim 20, further including a flow apportioning element upstream of the heater controllably apportioning fuel flow between an inside flow path and inside flow path and an outside flow path past the heater.

31. The fuel injector according to claim 2, wherein the conductors are at least partially encased in an electrically insulating cover.

32. The fuel injector according to claim 1, wherein at least one spring washer supports the heater.

33. The fuel injector according to claim 32, wherein at least one heater clip supports the heater.

34. The fuel injector according to claim 1, wherein at least one heater clip supports the heater.

35. A fuel injector comprising:

a valve body having a bore adapted to receive fuel;

a valve seat mounted at one end of the valve body, the valve seat having an orifice;

a needle valve having one end operatively connected to an armature and another end engagable with the valve seat to permit or inhibit fuel flow through the orifice;

a magnetic coil operator assembly being mounted in a housing attached to another end of the valve body, and including electrical connectors to connect the magnetic coil operator assembly to an electrical control circuit; and a heater in the bore of the valve body upstream of the valve seat and downstream of the magnetic coil operator assembly such that the heater extends around the needle valve and fuel surrounds the heater.

36. A fuel injector according to claim 35, further comprising conductors extending into the bore from the housing, past the magnetic coil operator assembly, and electrically connected to the heater.

37. A fuel injector according to claim 36, further comprising sealing means associated with each of the conductors that prevent escape of pressurized fuel in the bore past the conductors.

* * * * *